US010039972B2

(12) United States Patent
Katz

(10) Patent No.: US 10,039,972 B2
(45) Date of Patent: Aug. 7, 2018

(54) PLAYING CARD DISPENSER AND DISPLAY APPARATUS

(71) Applicant: Dean Z. Katz, Palm Beach Gardens, FL (US)

(72) Inventor: Dean Z. Katz, Palm Beach Gardens, FL (US)

( * ) Notice: Subject to any disclaimer, the term of this patent is extended or adjusted under 35 U.S.C. 154(b) by 0 days.

(21) Appl. No.: 15/282,275

(22) Filed: Sep. 30, 2016

(65) Prior Publication Data

US 2018/0093166 A1 Apr. 5, 2018

(51) Int. Cl.
*A63F 1/10* (2006.01)
*A63F 1/00* (2006.01)

(52) U.S. Cl.
CPC ..... *A63F 1/10* (2013.01); *A63F 2001/006* (2013.01)

(58) Field of Classification Search
CPC ..... A63F 1/10; A63F 2001/006
See application file for complete search history.

(56) References Cited

U.S. PATENT DOCUMENTS 1,286,780 A * 12/1918 Ribeyre ..... A63F 1/10 273/150
1,347,839 A 7/1920 Coons
1,716,022 A * 6/1929 Baker ..... A63F 1/10 273/148 A
1,903,744 A 4/1933 Heusser et al.
2,608,291 A 8/1952 Alford
2,677,548 A 5/1954 Szel
4,927,146 A * 5/1990 Bull ..... A63F 1/10 273/150
6,491,299 B1 * 12/2002 Gordon ..... A63F 1/06 273/148 A
2010/0069160 A1 * 3/2010 Barrett ..... G07F 17/32 463/46

OTHER PUBLICATIONS

Steppes Hill Farm Antiques Ltd. Edwardian Silver Combined Trumps Marker/Playing Cards Holder. Archived copy from Jul. 2, 2017. [retrieved on Nov. 17, 2017], Retrieved from the Internet:<URL:https://web.archive.org/web/20160702083213/http://www/steppeshillfarmantiques.com/silver-and-porcelain/edwardian-silver-combined-trumps-marker-playing-cards-holder/151579>, entire document.

International Search Report and Written Opinon for International Application No. PCT/US2017/054360, dated Dec. 22, 2017, eight (8) pages).

* cited by examiner

*Primary Examiner* — Michael Dennis
(74) *Attorney, Agent, or Firm* — Richard Harris; Greenberg Traurig, LLP

(57) ABSTRACT

A card dispenser and display apparatus for securely loading, maintaining, removing and displaying game cards during the playing of a game. The apparatus includes a housing and a generally planar base. The inner space of the housing is configured to contain a plurality of cards having a uniform height and width. The inner space of the housing has a width that is substantially equal to the uniform width of the plurality of cards, at least a portion of which housing has a height that is lower than the uniform height of the plurality of cards, thereby enabling a user to manually lift a card from the front of the housing to move the card to the back of the housing, as well as enabling the removal of a deck of playing cards from the housing.

8 Claims, 10 Drawing Sheets

PLAYING CARD DISPENSER AND DISPLAY APPARATUS

FIELD OF THE INVENTION

This present invention generally relates to card dispenser and display devices and systems, and more specifically relates to apparatuses for securely loading, maintaining, removing and displaying standard playing cards during the playing of a card game, such as Gin Rummy.

BACKGROUND OF THE INVENTION

Playing cards have been very popular for centuries and are a basis for a large number of games, often for prizes, scores and compensation. Playing cards have typically been defined as being one of two different standard kinds, Poker-type playing cards having the approximate dimension of 3½ inches high by 2½ inches wide, and Bridge-type playing cards which are approximately 3½ inches high and 2¼ inches wide. During the playing of many playing card games, playing cards will need to be dispensed, maintained and displayed to players. Particularly, when a playing card (e.g., a Knock Card for a Gin Rummy game) needs to be displayed for the purposes of game play, it usually reveals important information for the players to consider and analyze, often determining further game strategies. As such, for the integrity and fairness of the game, it is necessary to avoid accidentally (or purposefully) displaying playing cards (or any portion of the playing cards such as its color, suit, number or value) that are not intended to be shown to the players. In so doing, it is important to adequately, simultaneously display the card to a number of players in different player locations around one or more tables, with the card readily viewable by all viewers and located in a stable position. By way of example, the game of Gin Rummy is typically played utilizing two teams of 2, 3 or more players on each team, where the players are simultaneously playing one hand against their respective opponent. When all of the players have completed their hand, the common Knock Card is changed for the next hand. This can be accommodated by preferably, moving the current Knock Card to the back of the Knock deck, to expose the next card behind it—or by drawing the last card in the Knock deck to the front of the Knock deck—to overlay and cover the immediately prior Knock Card. Regardless of how the old Knock Card is succeeded by the new Knock Card, it is crucial that upcoming cards in the deck, at either the front or the rear of the Knock deck, are not revealed to any of the players.

If one has knowledge of what the next or any subsequent Knock Card will be, this knowledge could affect how the current hand could be played. It is even more crucial if a "spade" card, which typically carries double points in a hand, is prematurely exposed. Depending on the situation, a player who knows what the next or subsequent cards are may choose to end a current hand by "knocking" instead of taking a risk on playing for gin. If a "must-gin Ace" is prematurely exposed, this could also affect how the current hand is played. In both of these examples, amongst others, the premature exposure of Knock Cards is most crucial when a team is in a "blitz" situation, which typically doubles the points for the entire game. The number of points a player collects can often be determinative of the level of either prizes or monetary compensation the player receives.

The present playing card dispenser and display apparatus levels the playing field for Gin Rummy card players by preserving the integrity of the game. It ensures that a skilled player can win by placing safeguards against other players gaining an unfair advantage by the premature exposure of a Knock Card destined for a subsequent hand. It guards against a potentially dishonest player working with cards that are not secure, who could otherwise be able to take advantage of the Knock Card sequence—or otherwise manipulate the Knock Card or the conventional glass or other holder, to see upcoming Knock Cards.

Conventionally, players would either display the playing card(s) (such as the knock card) on a flat surface (e.g., a table), which is not a very effective or convenient way for the viewers, or use a simple upright object (e.g., a whiskey or cocktail glass) to hold and display the playing card(s) needed to be seen by all of the players. For instance, it is common to use a whiskey glass to hold a full deck of playing cards, and to move and display the knock card. However, in practice, the size and shape of a whiskey glass is not tailored to fit a standard playing card deck, or several standard-size playing cards. As such, when the Knock Card deck is placed and displayed in the whiskey glass, the cards can move or shift within the glass, thereby resulting in an inadvertent premature displaying of the future Knock Card(s) behind the forward-most playing card. This inadvertent or intentional exposure could provide an unfair advantage to one or more particular players and also disturb the gaming process. Thus, the conventional ways for dispensing and displaying future Knock Cards are neither convenient nor secure—and could serve to affect the integrity of the game, by affecting the outcome of a particular deal and any subsequent deals. It is especially crucial to avoid the premature exposure of future Knock Cards when changing the Knock Card, whether it is changed front to back, or vice versa.

SUMMARY OF THE INVENTION

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

The invention comprises a card dispenser and display apparatus for securely loading, maintaining, removing and displaying a deck of standard-sized game cards during the playing of a card game. The apparatus according to this invention includes a generally horizontal planar base having a top surface and a bottom surface, and a housing on the top surface of the planar base—for dispensing and displaying one or more standard playing cards from a standard deck (of either Poker-style or Bridge-style cards) therewithin, while facilitating the changing of the displayed card. An adapter insert is contemplated for converting the housing from accepting Poker-style playing cards to the slightly smaller Bridge-style playing cards.

In a preferred embodiment, the housing includes a rear wall substantially adjoining the planar base, wherein the rear wall forms an angle ranging from about zero (0°) degrees to about one hundred eighty (180°) degrees, relative to the planar base; a front wall substantially parallel to the rear wall; two opposite side walls substantially parallel to one another, carefully sized to closely and telescopically receive a standard playing card deck, with the sides extending between the front wall and the rear wall to join same respectively, the side walls being spaced apart from one another just slightly more than the approximate width of a standard playing card; a bottom wall substantially proximate to the planar base, the front, rear, side and bottom walls collectively forming a deck storage and displaying region.

The deck storage and displaying region as defined by the front, rear, side and bottom walls is configured to contain a plurality of standard playing cards, up to an entire deck, having a uniform height and width, in which at least one of the front, side and/or rear walls is lower than the uniform height of the plurality of playing cards. The width and the height of the housing are configured to enable a user to manually lift a card from the front of the housing, and to move the card to the back of the housing. Alternatively, a user may manually lift a card from the rear of the deck, at the rear of the housing, to move the card to the front of the housing, to cover up the immediately prior Knock Card with the new Knock Card. Further, the front wall enables the displaying of at least the top portion of the forward-most playing card to reveal its value and suit, while blocking at least the bottom portion of the forward-most playing card to preclude the inadvertent, premature displaying of any playing cards behind the forward-most playing card.

In some embodiments, where the apparatus is at least partly made of a transparent material, and the housing includes a front shield or visual barrier to cover at least the bottom portion of the front wall, so that when the forward-most card is lifted from the front of the housing, the front shield blocks the inadvertent displaying of the bottom or sides of any of the remaining cards in the deck.

In some embodiments, each side wall of the housing further includes a side shield to block at least a bottom portion of the side of the housing, to block the view of the side of the cards.

In some embodiments, the bottom wall of the housing integrally comprises at least part of the planar base. In some preferred embodiments, the bottom wall of the housing forms a generally right angle relative to the rear wall of the housing.

In yet other embodiments of the invention, the angle between the rear wall and the planar base ranges from about sixty-five (65°) degrees to about eighty-five (85°) degrees. The angle between the rear wall and the planar base can be either fixed or adjustable, through the use of hinges and adjustable ridges or strips in the base.

In some embodiments, each side wall of the housing is in the shape of a rectangle, a parallelogram, or a trapezoid. In some embodiments, each side wall of the housing is in a shape of a trapezoid.

In one preferred embodiment, at least one of the front wall and the rear wall of the housing is shaped as a rectangle. In yet other embodiments, the front wall or the rear wall of the housing includes a cut-out portion for lifting or placing the cards, either individually, or as a deck. Still, in other embodiments, the front wall and the rear wall are of the substantially same height.

In some embodiments, each side of the apparatus further includes a triangle-shaped side wing extending between the rear wall and the planar base.

In other embodiments of the invention, the housing is movable or rotatable relative to the planar base. For instance, the apparatus may include a back support element for supporting the housing. The back support element may be bendable, flexible or hinged. In some more specific embodiments, the back support element is pivotally attached to the rear wall of the housing or the planar base. The back support element may include a hinge to collapse a supporting leg at the point of attachment to the housing as well as capable of pivoting relative to the base. In other embodiments, the back support element is fixed and attached to the rear wall of the housing and the planar base. Further, there may be one or more stop elements on the planar base, for adjustably maintaining the position of the housing relative to the planar base. The stop element may include a notch, a groove, a strip, or a ledge. The stop element may include a non-skid layer as the top surface of said planar base. The angle between the rear wall and the planar base then may be adjusted by positioning the housing or the support element at different stop elements.

In the preferred embodiment of the invention, the planar base has a non-slip bottom surface, or includes one or more non-slip tabs.

In some embodiments, the planar base, walls, cover or wings of the apparatus may include a region for accommodating promotional notation or other designs and/or text, such as a casino name, a restaurant, or a country club logo.

The invention also contemplates the use of small strips of either plastic or other material as an insertable adapter for raising the height of the bottom wall, or for narrowing the distance between the side walls, to accommodate the height or width respectively of an alternatively sized deck—or to convert the housing from one sized for a Poker-type playing card to one sized for a Bridge-type playing card.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure Rather, the same reference number may be used to indicate a similar feature or a feature with similar functionality, as may non-identical reference numbers.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. To the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and other features have not been described in detail as not to unnecessarily obscure aspects of the present playing card dispenser and display apparatus.

Generally speaking, various embodiments of the present invention provide for a card dispenser and display apparatus for securely loading, maintaining, removing and displaying standard sized game cards during the playing of a card game, such as Gin Rummy. Particularly, the cards are standard playing cards (e.g., knock cards for Gin Rummy games). A user may place a deck of playing cards into the housing in a front-facing manner. When the deck is placed in the housing, at least a top portion of the forward-most playing card is revealed to show its value and suit, while at least a bottom portion of the forward-most playing card is blocked to preclude the inadvertent pre-mature displaying of any playing cards behind the forward-most playing card, while the cards are maintained within the deck, until (and while) the Knock Card is changed. During the playing of the game (e.g., Gin Rummy games), the user can preferably lift the forward-most playing card and move it to the back of the housing, thereby displaying the next front card of the deck. The apparatus according to this invention is configured to avoid accidentally, purposefully or mistakenly revealing other cards behind the forward-most playing card, thereby ensuring the fairness of the game, while maximizing viewing by all of the players.

Figure 1:
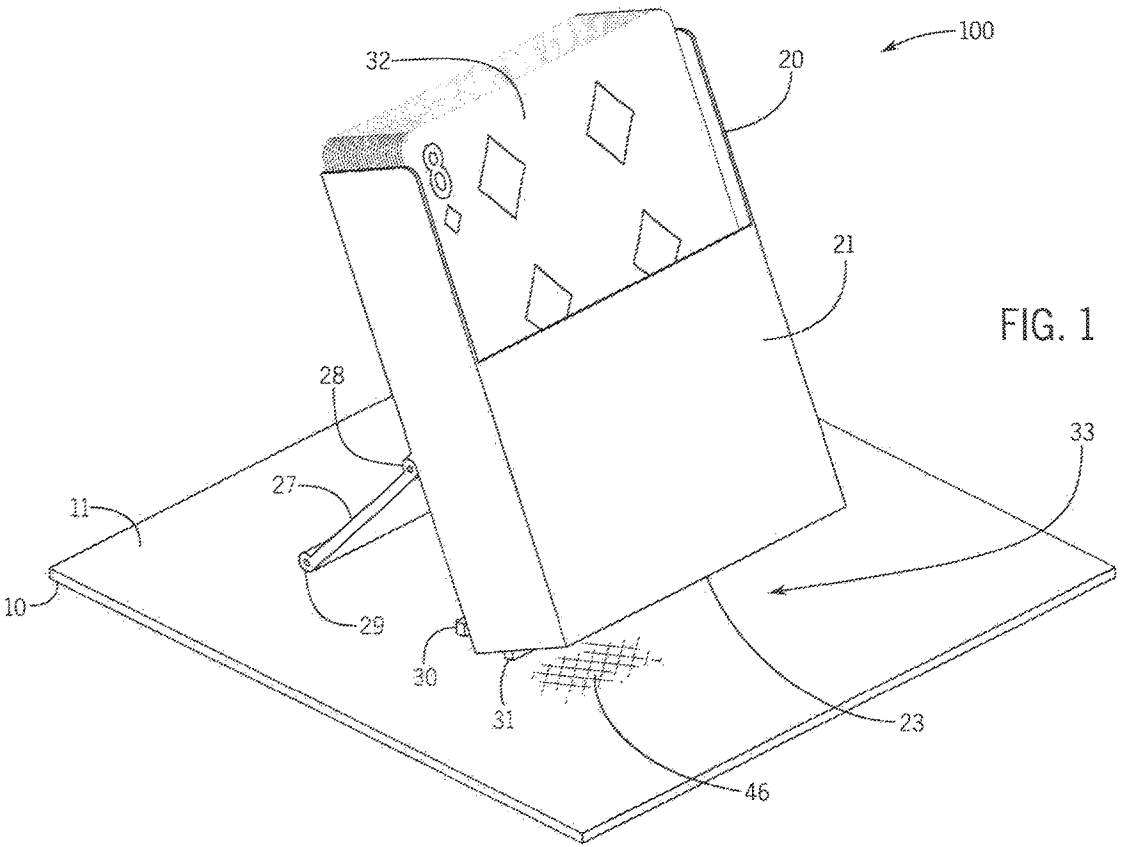
FIG. 1 is a perspective view of a first embodiment of card dispenser and display apparatus according to various embodiments of the disclosure.

FIGS. 1-6 show card dispenser and display apparatus 100 according to the present invention. FIG. 1 shows a perspective view of the card dispenser and display apparatus 100, and FIGS. 2-6 show the front, side, rear, top, and bottom view of apparatus 100, respectively.

Figure 2:
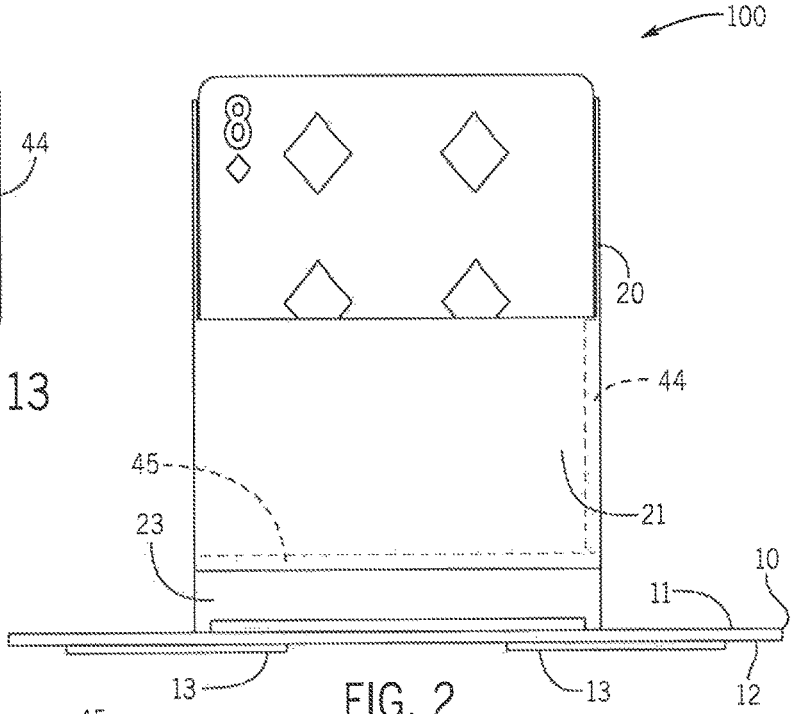
FIG. 2 is an elevated front view of the card dispenser and display apparatus of FIG. 1, according to various embodiments of the disclosure.
Figure 4:
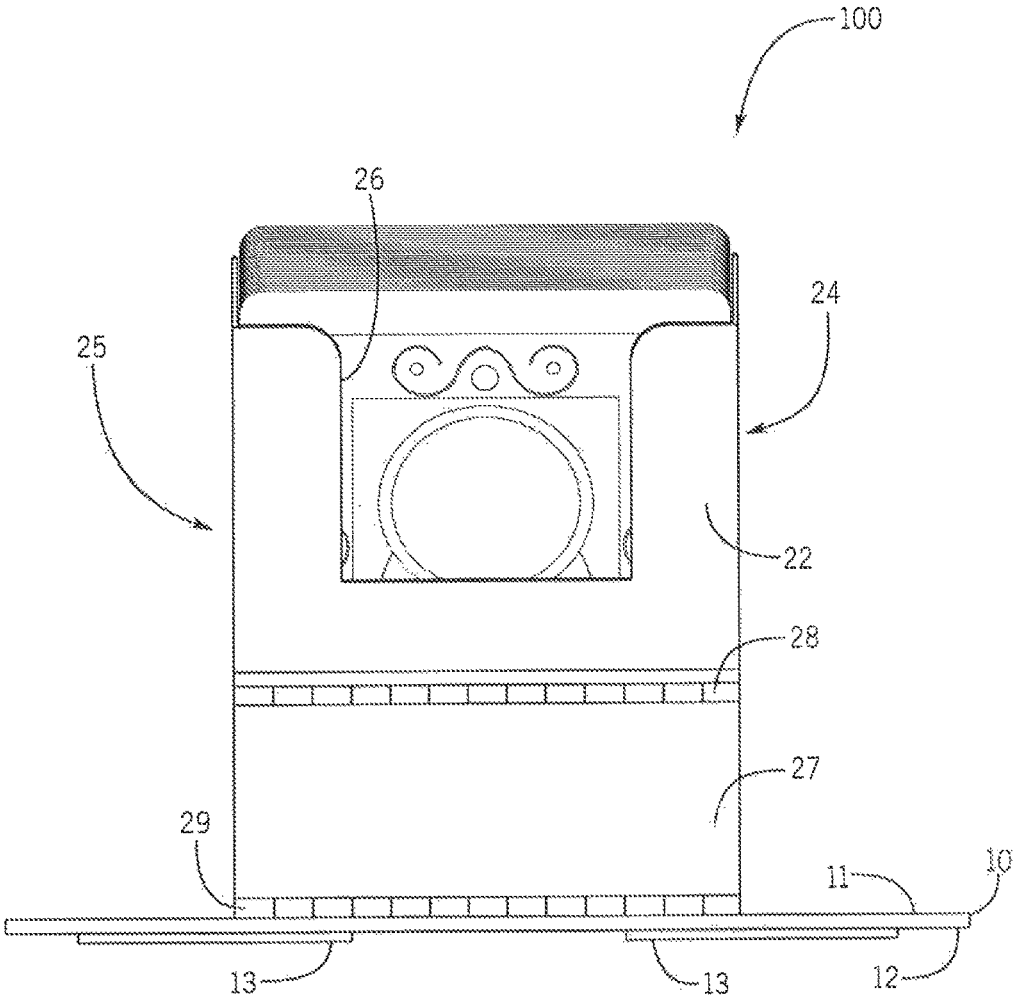
FIG. 4 is an elevated rear view of the card dispenser and display apparatus of FIG. 1, according to various embodiments of the disclosure.

As shown in FIG. 1, card dispenser and display apparatus 100 includes generally horizontal planar base 10, and housing 20 for dispensing and displaying a deck of standard playing cards from therewithin. Particularly, FIGS. 1, 2 and 4 show apparatus 100 containing a deck of standard playing cards in housing 20, displaying forward-most card 32 as the eight of diamonds. Promotional text region 33 is likewise shown.

Figure 3:
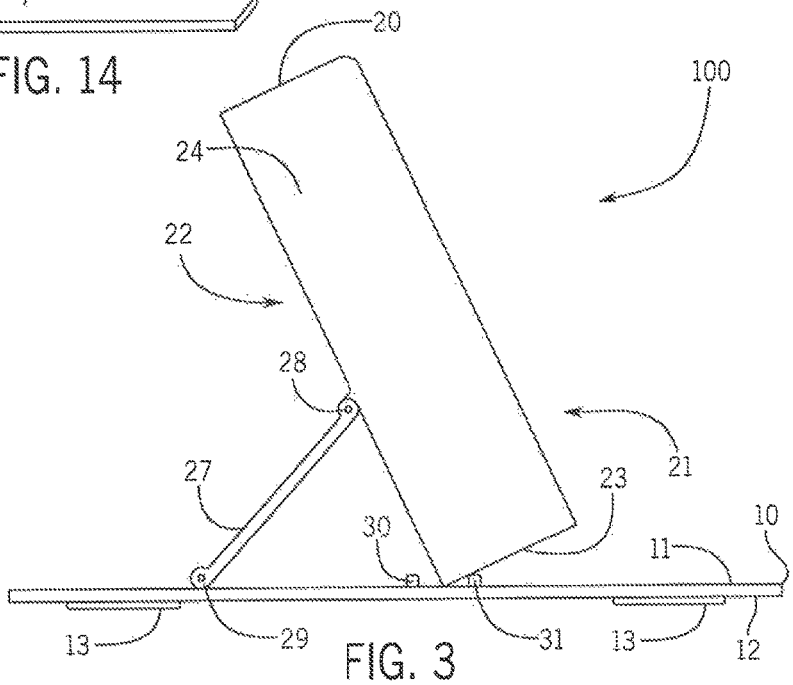
FIG. 3 is an elevated side view of the card dispenser and display apparatus of FIG. 1, according to various embodiments of the disclosure.
Figure 6:
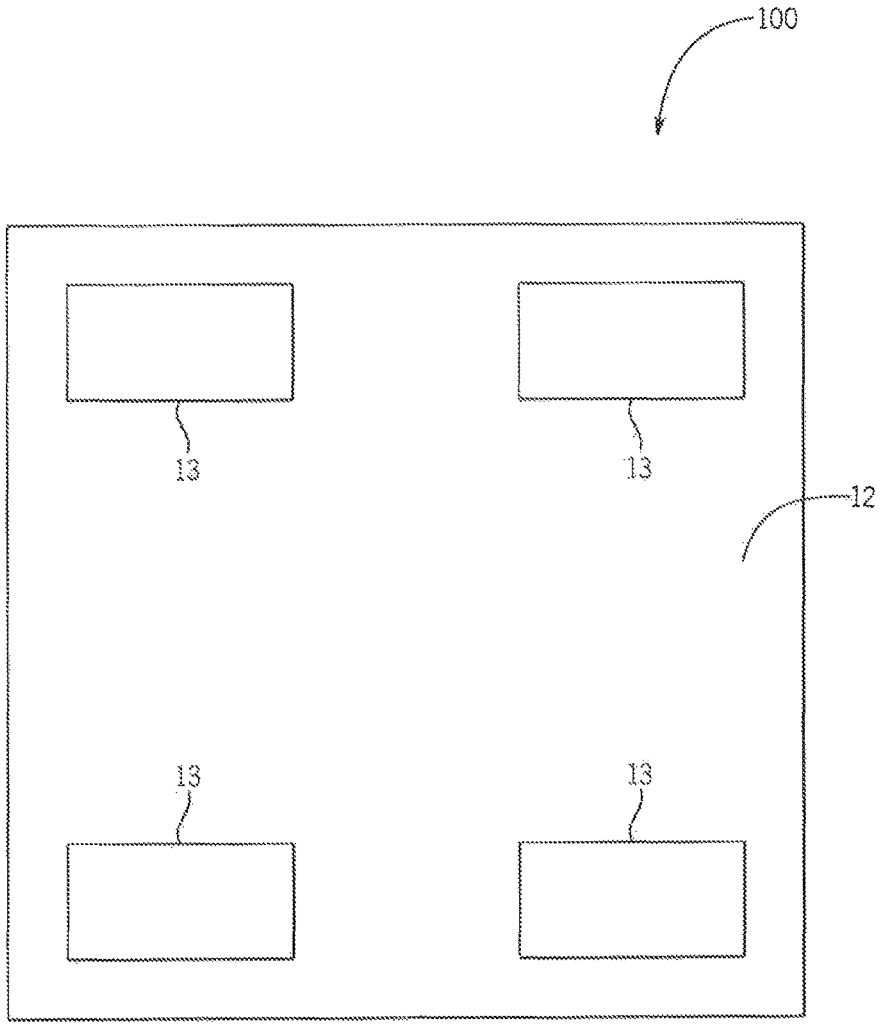
FIG. 6 is a bottom view of the card dispenser and display apparatus of FIG. 1, according to various embodiments of the disclosure.

Generally, horizontal planar base 10 includes top surface 11 and bottom surface 12, as shown in FIGS. 1, 3 and 6. When in use, apparatus 100 is usually placed on a flat surface (e.g., a table). To increase the stability of apparatus 100, preferably, bottom surface 12 of apparatus 100 (see FIGS. 2 and 3) may be made of a non-slip material, or include one or more non-slip tabs or pads. For instance, as shown in FIG. 6, there are four friction pads 13 attached to the bottom of base 10.

Housing 20 is positioned atop surface 11 of base 10, as shown in FIGS. 1-6. More specifically, housing 20 includes front wall 21, rear wall 22, bottom wall 23, and two opposite side walls 24 and 25. Those five walls collectively form an inner space—a deck storage and displaying region—having a width, as determined by the spacing between side walls 24 and 25, which is just slightly larger than the width of a standard playing card, so as to snugly, yet telescopically, receive the deck.

Front wall 21 of housing 20, as well as other parts of housing 20, and apparatus 100, may be made of an opaque material, as long as the top portion of the top forward-most portion of playing card 32 is sufficiently revealed to display its value and suit. For instance, as shown in FIGS. 1 and 2, front wall 21 is made of an opaque material, and is substantially lower than the height of standard playing card 32. As such, the top portion of the forward-most playing card is sufficiently revealed to show that the card is the eight of diamonds. Further, as shown in FIGS. 1 and 2, front wall 21 is in the shape of a rectangle. In other embodiments, front wall 21 may also include a cut-out portion for more easily grabbing and lifting (or inserting) the card, or the deck as a whole.

Figure 5:
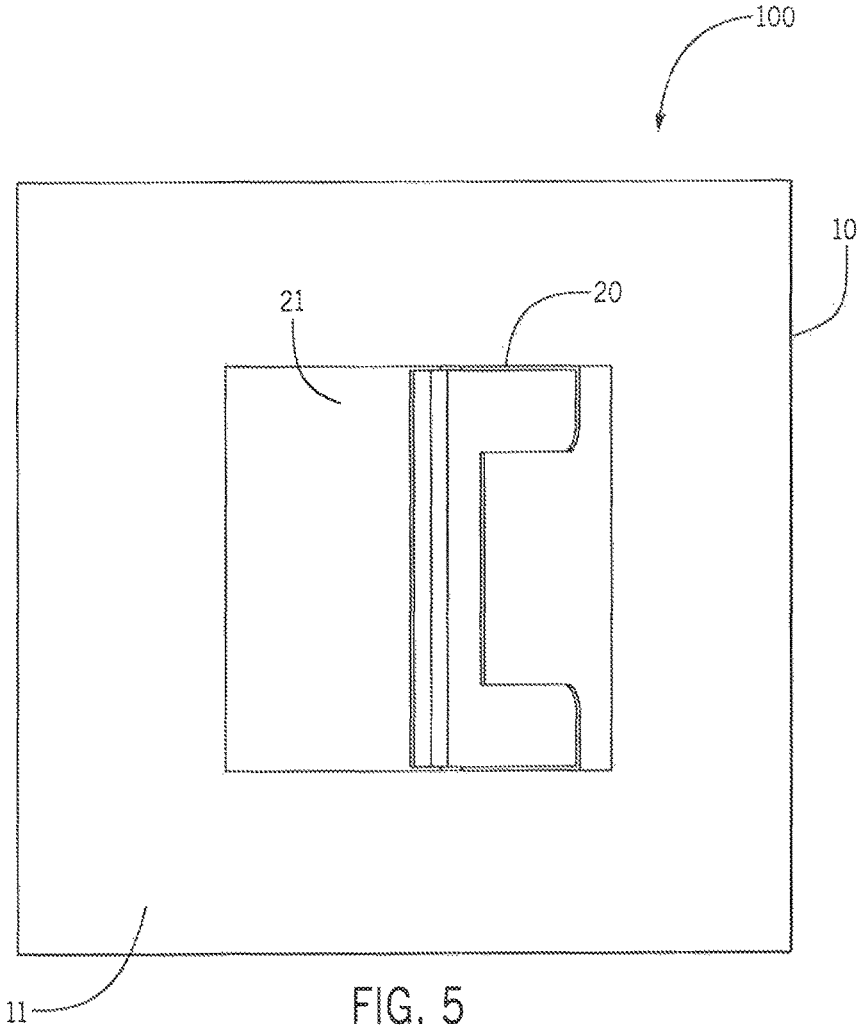
FIG. 5 is a top plan view of the card dispenser and display apparatus of FIG. 1, according to various embodiments of the disclosure.

Rear wall 22 of housing 20, as shown in FIGS. 3 and 4, is substantially parallel to front wall 21. Moreover, as shown in FIGS. 4 and 5, rear wall 22 may include a cut-out portion, such as slot 26, for more easily grabbing the cards, either individually or by the deck, as a whole.

As shown in FIGS. 1 and 3, rear wall 22 substantially adjoins base 10, forming an angle relative to base 10. That angle serves to improve the comfort and the convenience for a user to view the Knock Card during the playing of the game. Specifically, that angle may range from zero (0°) degrees to about one hundred eighty (180°) degrees, or more preferably from about sixty-five (65°) degrees to about eighty-five (85°) degrees. The angle between rear wall 22 and base 10 may be fixed or adjustable. In some embodiments, the housing may be movable or rotatable relative to the planar base.

To support or adjust rear wall 22, as shown in FIGS. 1, 3 and 4, housing 20 may also include a back support element, such as supporting leg 27, pivotally attached to rear wall 22, at hinge 28, and likewise pivotally attached to base 10 at hinge 29. In some embodiments, back support element 27 may be bendable or flexible. With back support element 27 being pivotally attached to the rear wall of the housing and/or the planar base at hinges 28 and 29 (as shown in FIGS. 1 and 3), a manufacturer or user of the apparatus can collapse the supporting leg, for storage or shipping of apparatus 100.

In other embodiments, top surface 11 of base 10 may include non-slip material 46, or have one or more stop elements (e.g., a notch, a groove, a strip or a ledge) such as strips 30 and 31 along top surface 11 of planar base 10, adjustably maintaining the position of the housing or the support element. As such, the angle between the rear wall and the planar base may be adjusted by positioning the housing or the support element at different stop elements, to enhance the viewing of displayed card 32.

As shown in FIGS. 4 and 5, rear wall 22 may include a cut-out portion (e.g., slot 26) for a user to more easily grab the cards, either individually or by the deck.

Regarding the side walls of housing 20, as shown in FIGS. 1, 2 and 4, two opposite side walls 24 and 25 are substantially parallel to one another, and are spaced apart from one another just slightly wider than the approximate width of a standard playing card, such as either a Poker-style or Bridge-style playing card. As such, undesired skewing or shifting of the playing cards in the housing is limited, thereby reducing the risk of the inadvertent premature displaying of any playing cards behind the forward-most playing card. While some playing card decks are thicker than others, it is contemplated that the depth of the housing will be of such a dimension to accommodate most such standard thicknesses. Alternatively, the use of an additional adapter insert is contemplated to accept a thinner deck, where any such adapter can be adhered to the insides of the front, rear, side or bottom walls by an adhesive layer for example, to accommodate variations in the height, width or depth of a deck.

Further, according to this invention, each side wall 24, 25 of housing 10 may be shaped as a rectangle, a parallelogram, or a trapezoid. For instance, as shown in FIG. 3, opposite side walls 24 and 25 both have a rectangular shape.

Bottom wall 23 of housing 20, as shown in FIGS. 1 and 3, is substantially proximate to top surface 11 of base 10. Preferably, the angle between bottom wall 23 and rear wall 22 is about 90 degrees, so that there is no skewing of the cards when the deck of playing cards is placed in the housing. This further precludes the inadvertent premature displaying of any playing cards behind forward-most playing card 32.

Optionally, apparatus 100 may further include a country club logo or other indicia at a suitable place, such as top surface 11 of base 10, before front wall 21, at logo position 33.

Figure 7:
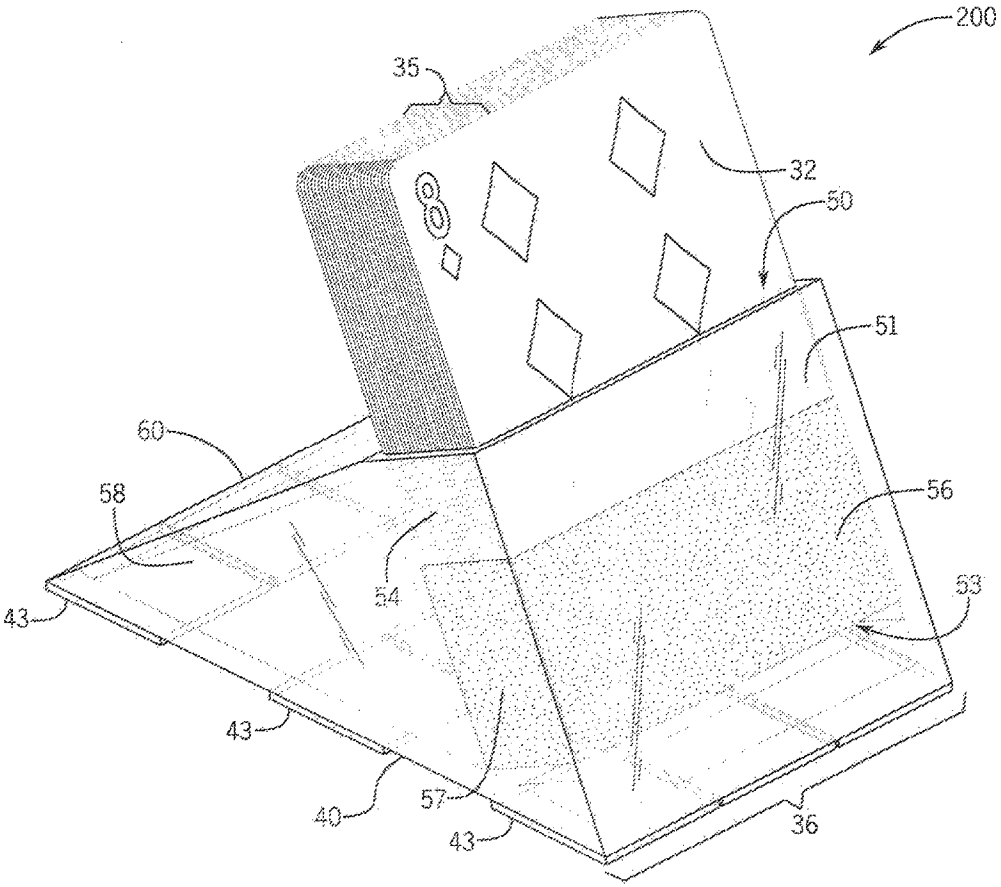
FIG. 7 is a perspective view of another embodiment of card dispenser and display apparatus according to various embodiments of the disclosure.

FIGS. 7-12 show another embodiment of card dispenser and display apparatus 200, according to the present invention. FIG. 7 shows a perspective view of the card dispenser and display apparatus 200, and FIGS. 8-12 show the front, side, rear, top, and bottom view of apparatus 200, respectively.

Figure 8:
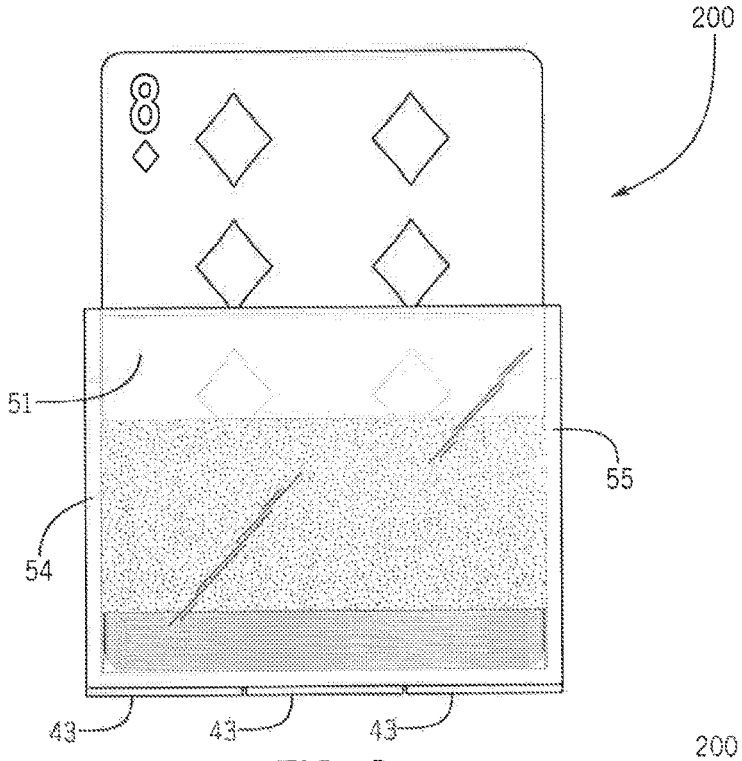
FIG. 8 is an elevated front view of the card dispenser and display apparatus of FIG. 7, according to various embodiments of the disclosure.
Figure 9:
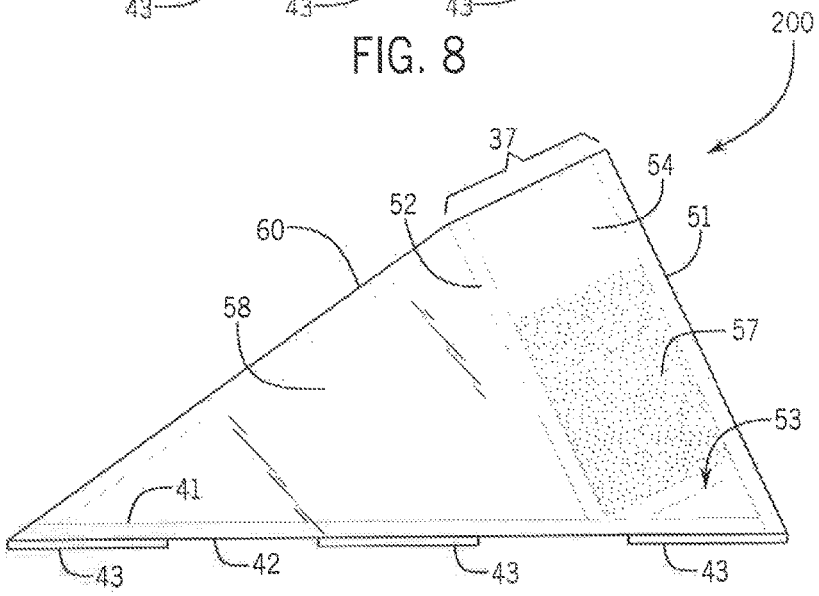
FIG. 9 is an elevated side view of the card dispenser and display apparatus of FIG. 7, according to various embodiments of the disclosure.

Card dispenser and display apparatus 200 includes a generally horizontal planar base 40, and housing 50 for dispensing, maintaining and displaying a deck of standard playing cards from therewithin, including forward-most card 32. Particularly, FIGS. 7, 8 and 9 show apparatus 200 containing a deck of standard playing cards in housing 50. The deck storage and display region formed by the walls of housing 50 accommodates thickness 35 of a standard playing card deck contained therewithin, through depth 37 (FIG. 9) between front wall 51 and rear wall 52. Likewise, side walls 54 and 55 are spaced apart to width 36 to closely receive the standard playing cards, while preventing shifting.

Figure 12:
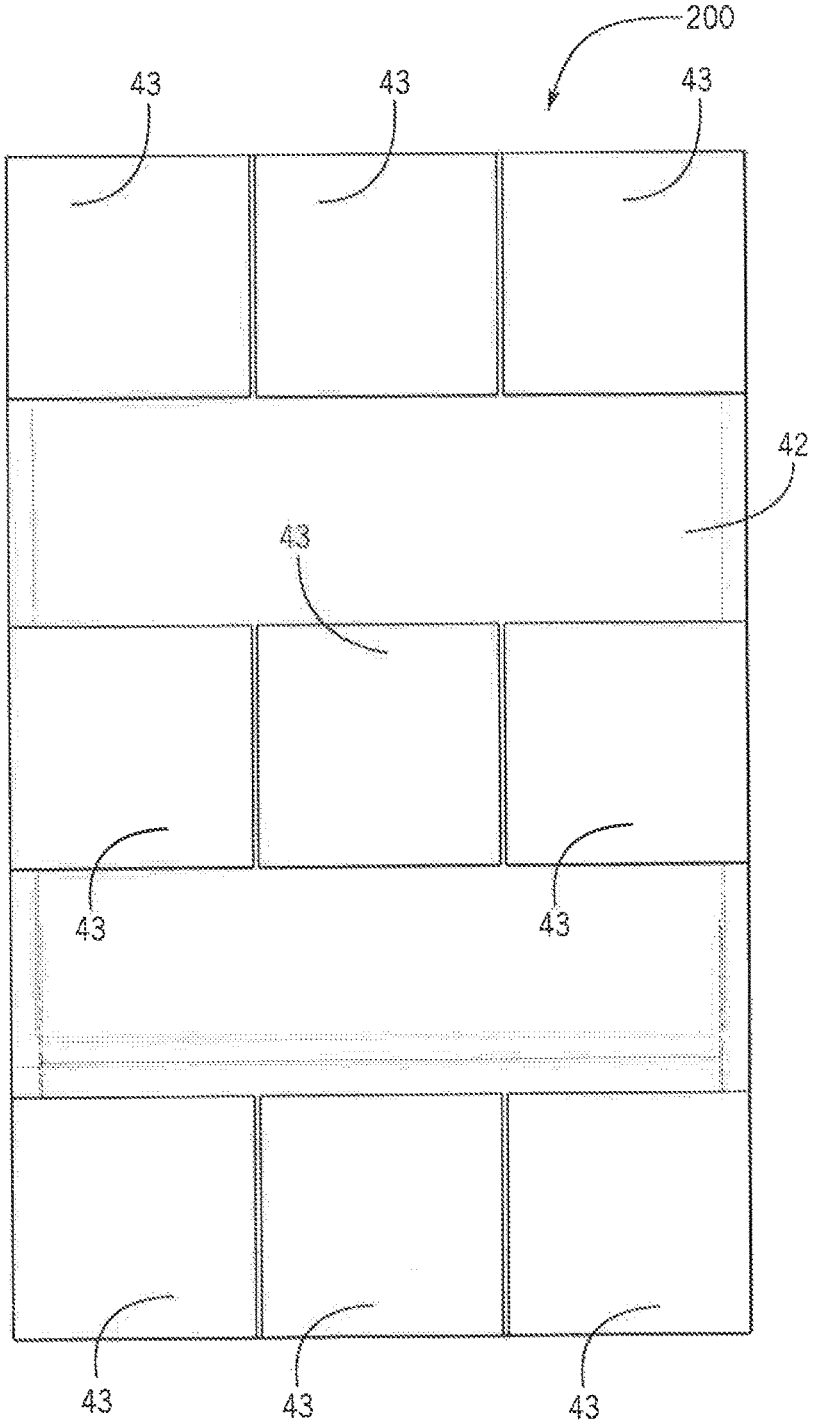
FIG. 12 is a bottom plan view of the card dispenser and display apparatus of FIG. 7, according to various embodiments of the disclosure.

Generally, horizontal planar base 40 includes top surface 41 and bottom surface 42, as shown in FIGS. 7, 9 and 12. To increase the stability of apparatus 200 on a surface (e.g., a table), bottom surface 42 of base 40 may be made of a non-slip material, or includes one or more non-slip tabs. For instance, as shown in FIGS. 7 and 12, there are nine friction pads 43 located at the bottom of base 40.

Housing 50 is positioned on top surface 41 of base 40, as shown in FIGS. 7-12. Housing 50 includes front wall 51, rear wall 52, bottom wall 53, and two opposite side walls 54 and 55. Those five walls collectively form an inner space—i.e., a deck storage and displaying region—which has a width closely approximate to the width of a standard playing card.

Front wall 51 of housing 50, as well as other parts of apparatus 200, may be fabricated of a substantially transparent material. As such, forward-most playing card 32 in housing 50 is also partially visible through the transparent portion of front wall 56. As shown in FIG. 7, forward-most playing card 32 (i.e., eight of diamonds) is also visible through the transparent portion of front wall 51. As shown in FIGS. 7 and 8, front wall 51 includes a front shield or barrier region 56 to block at least the bottom portion of forward-most playing card 32, thereby precluding the inadvertent premature displaying of any playing cards behind the forward-most playing card, while removing the forward-most playing card, toward relocating it, after use, to the back of housing 50 adjacent back wall 52. Though less preferred, the Knock Card can also be changed by drawing a card from the rear of the Knock deck and placing it over the front of the current Knock Card. Using that technique, the display of the cards in front of the rear card should be precluded. Further, as shown in FIGS. 7 and 8, front wall 51 is in the shape of a rectangle. In some other embodiments, front wall 51 may also include a cut-out portion for a user to more easily grab and lift the card, or the deck as a whole.

Side walls 54 and 55 of housing 50, as shown in FIGS. 7 and 9 are opposite one another, and are substantially parallel to each another. Side walls 54 and 55 are spaced apart from one another at distance 36, the approximate width of a standard playing card. This serves to limit or avoid the undesired migration or shifting of the playing cards, and reduces the risk of the inadvertent premature displaying of any of the playing cards positioned behind forward-most playing card 32. Each of side walls 54 and 55 of housing 50 may be in the shape of a rectangle, a parallelogram, or a trapezoid. For instance, as shown in FIG. 9, side walls 54 and 55 each have a trapezoidal shape. Further, similar to front wall 51, when the housing is substantially transparent, preferably each of side walls 54 and 55 may also include a side shield (e.g., 57) to block at least the bottom side portion of the forward-most playing card, as well as the cards behind it.

Figure 10:
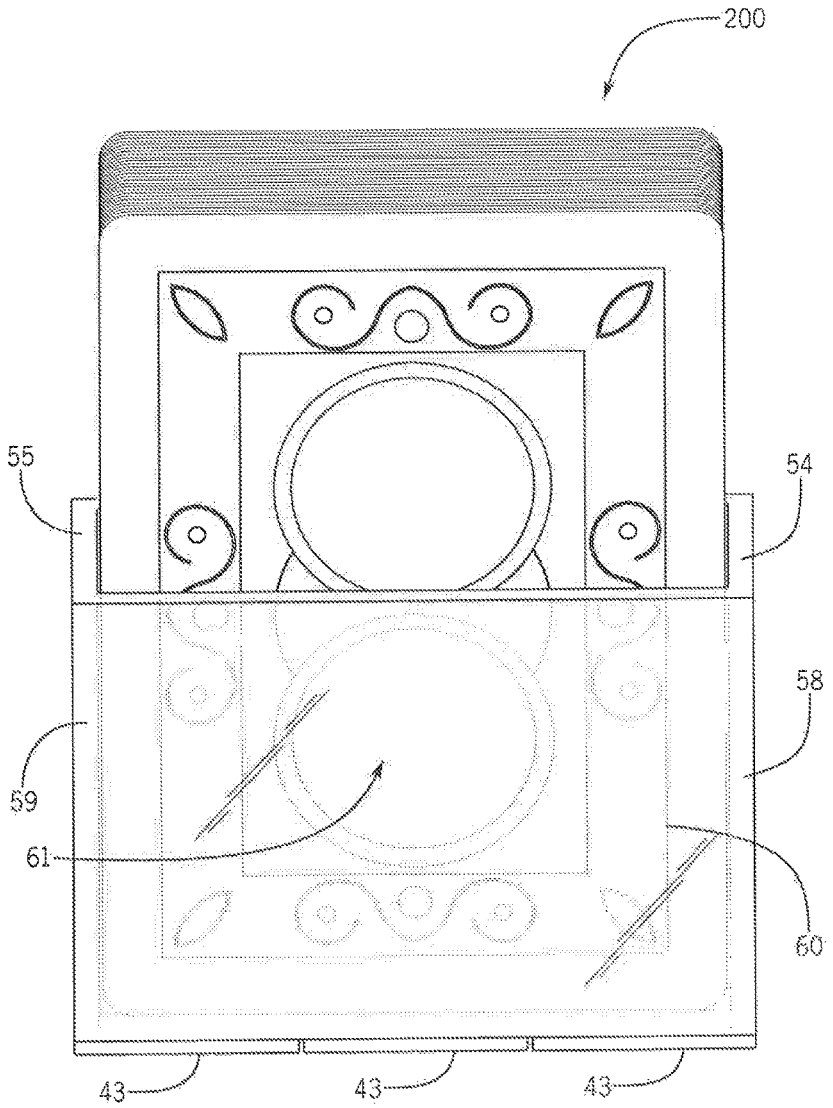
FIG. 10 is an elevated rear view of the card dispenser and display apparatus of FIG. 7, according to various embodiments of the disclosure.

As shown in FIG. 9, rear wall 52 is substantially parallel to front wall 51 and may be also in the shape of a rectangle, as shown in FIG. 10. As shown in FIGS. 7 and 9, rear wall 52 may adjoin base 40 to form an angle relative to base 40. That angle may range from about zero (0°) degrees to about one hundred eighty (180°) degrees, or more preferably from about sixty-five (65°) degrees to about eighty-five (85°) degrees, thereby improving the position from which users can view the card(s) displayed by apparatus 200 during the playing of the game.

Figure 11:
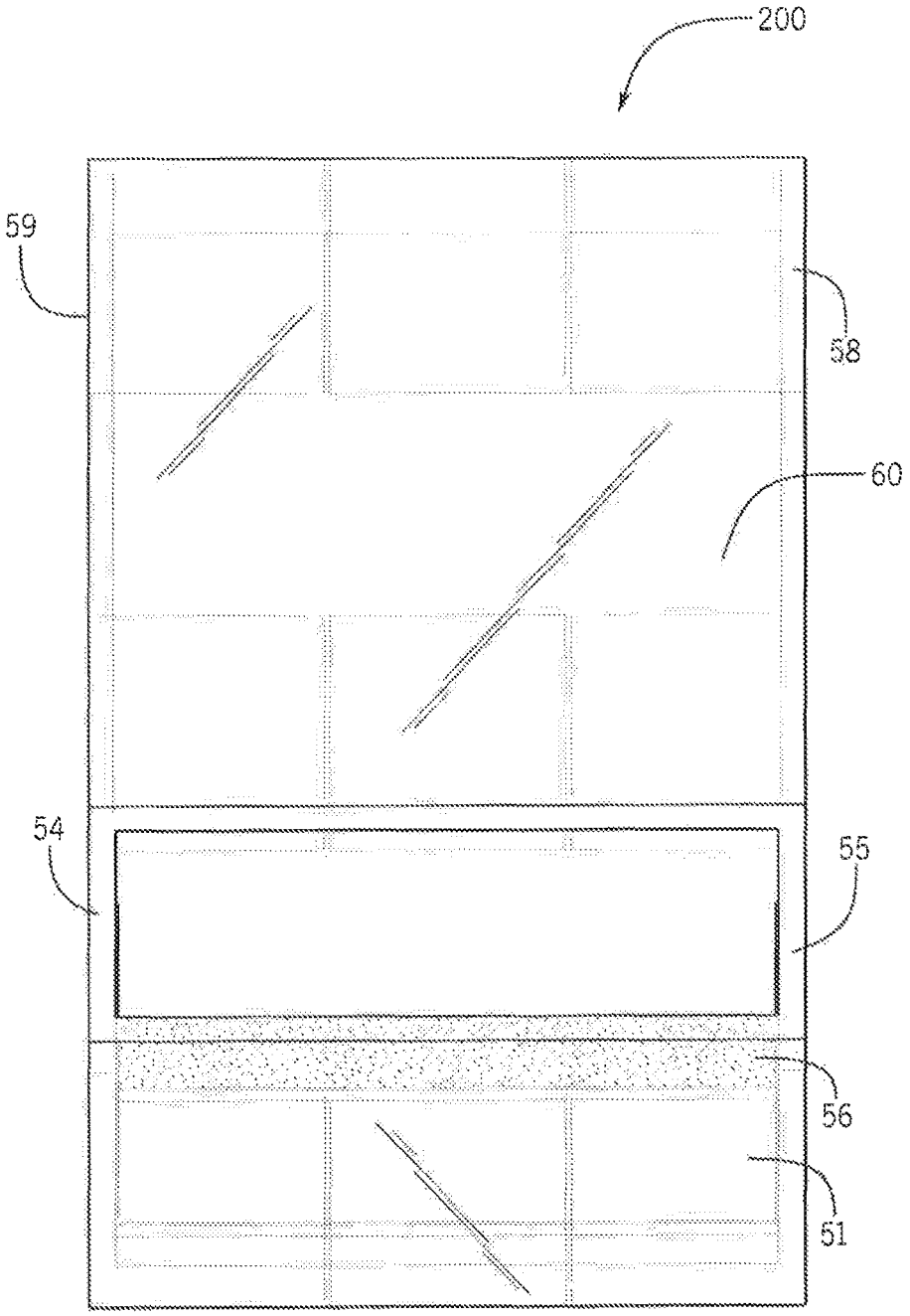
FIG. 11 is a top plan view of the card dispenser and display apparatus of FIG. 7, according to various embodiments of the disclosure.

Further, as shown in FIGS. 7, 9 and 11, to support or balance rear wall 52, housing 50 may include two opposite side wings (e.g., triangle-shaped side wings 58 and 59), and, optionally, top cover 60 extending between rear wall 52 and base 40. Apparatus 200 may also include a country club logo on top cover 60, at logo position 61 (FIG. 10), or on side walls 54 and 55, or front wall 51.

Bottom wall 53 of housing 50 is shown in FIGS. 7 and 9, substantially proximate to base 40. Preferably, the angle between bottom wall 53 and rear wall 52 is about 90 degrees, so that there is no skewing or shifting of the cards within the deck, when playing cards are placed in, and maintained by, housing 50. This could further preclude the inadvertent premature displaying of any playing cards behind the forward-most playing card.

In some other embodiments, while the angle between the rear wall and the base is less than 90 degrees, the bottom wall may have a tapered thickness, in order to form a generally 90-degree angle between the bottom wall and the rear wall, and to ensure that there is no skewing of the playing cards in the housing.

Figure 13:
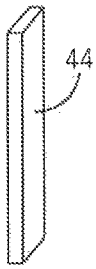
FIG. 13 is a perspective view of a housing width insert adapter for adjusting the width of the housing to accommodate a non-standard or different standard playing card deck width.

FIG. 13 shows width adapter insert 44 for insertion into housing 20 to adjust the width of the apparatus to accommodate a different size or format of deck, as also shown, in phantom, in FIG. 2. Insert 44 can be attached through the use of a peel-off-exposable adhesive.

Figure 14:
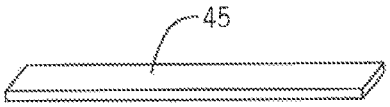
FIG. 14 is a perspective view of a housing height insert adapter for adjusting the height of the housing to accommodate a non-standard or different standard playing card deck height.

FIG. 14 shows height adapter insert 45 for insertion into housing 20 to adjust the height of the apparatus to accommodate a different size or format of deck, as also shown, in phantom, in FIG. 2. Insert 45 can likewise be attached in the inside of the housing through a suitable adhesive.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The invention claimed is:

1. A card dispenser and display apparatus for securely loading, maintaining, removing and displaying standard game cards during the playing of a card game, said apparatus comprising:

a generally horizontal planar base having a top surface and a bottom surface;

a housing on the top surface of the planar base configured for maintaining, dispensing and displaying one or more standard playing cards of the type dealt to each of the players to play the card game, from therewithin said housing, one at a time, said housing including a rear wall substantially adjoining the planar base; a front wall substantially parallel to the rear wall; two opposite side walls substantially parallel to one another, extending between the front wall and the rear wall to join same respectively, said side walls being spaced apart from one another the approximate width of a standard playing card; a bottom wall substantially proximate to said planar base, said front, rear, side and bottom walls collectively forming a substantially rectangular deck storage and displaying region so as to be capable of containing an entire deck of standard playing cards of the type being dealt to the players and displaying said one or more standard playing cards, one at a time, said deck storage and displaying region configured to display said one or more standard playing cards one at a time simultaneously to all of the players for the collective use thereby, to contain said deck of standard playing cards having a uniform height and width, without staggering the position of the playing cards to ensure the display of only one said playing card at a time;

at least one of said front, rear and side walls being lower than the uniform height of the playing plurality of cards; wherein the width and the height of the housing are configured to enable a user to manually lift a card from one of the front and rear of the housing, and to move the card to the other of the front and rear of the housing, as well as to lift at least a portion of the entire deck of playing cards from within said deck storage and playing region, said front wall enabling the displaying of at least a portion of only the forward-most playing card to reveal at least one of its value, color and suit, while blocking the display of the other playing cards contained within the apparatus, to preclude the inadvertent premature displaying of the value, color and suit of any of said other playing cards positioned behind said forward-most playing card, in which the apparatus further comprises a back support element for supporting the housing, said back support element being attached at one end to at least one of said housing and said planar base, wherein the back support element is attached at said one end to said housing, and at its other end to said planar base, wherein said back support element is pivotally attached to both said housing and said planar base at respective hinges.

2. The apparatus of claim 1, wherein the planar base further includes a strip to restrain the position of housing.

3. The apparatus of claim 2, wherein the planar base includes two or more strips to impart adjustability to the display angle of the housing.

4. The apparatus of claim 1, wherein the back support element is pivotally attached to both the rear wall of the housing as well as to the top surface of the planar base.

5. The apparatus of claim 1, further comprising one or more stop elements on the planar base, for adjustably maintaining the position of the housing, relative to the planar base.

6. The apparatus of claim 5, wherein the stop element comprises one or more of a notch, a groove, a strip, and a ledge.

7. The apparatus of claim 5, wherein the stop element comprises a non-skid layer as the top surface of said planar base.

8. The apparatus of claim 5, wherein the angle between the rear wall of the housing and the top surface of the planar base is adjusted by positioning the housing at a different stop element.

* * * * *